US005414403A

United States Patent [19]

Greuter et al.

[11] Patent Number: 5,414,403

[45] Date of Patent: May 9, 1995

[54] CURRENT-LIMITING COMPONENT

[75] Inventors: Felix Greuter, Rütihof; Claus Schüler, Widen; Ralf Strümpler, Baden, all of Switzerland

[73] Assignee: ABB Research Ltd., Zurich, Switzerland

[21] Appl. No.: 70,937

[22] Filed: Jun. 4, 1993

[30] Foreign Application Priority Data

Jun. 29, 1992 [DE] Germany ..... 42 21 309.6

[51] Int. Cl.[6] ..... H01C 7/10

[52] U.S. Cl. ..... 338/22 R; 338/22 SD; 338/23; 338/224; 338/320

[58] Field of Search ..... 338/22 R:22 SD, 23, 338/224, 319, 320, 20

[56] References Cited

U.S. PATENT DOCUMENTS

| | | | |
|---|---|---|---|
| 3,878,501 | 4/1975 | Moorhead et al. . | |
| 4,352,083 | 9/1982 | Middleman et al. | 338/23 |
| 4,534,889 | 8/1985 | van Konyenburg et al. . | |
| 4,647,900 | 3/1987 | Schelhorn . | |

FOREIGN PATENT DOCUMENTS

| | | |
|---|---|---|
| 621796 | 11/1935 | Germany . |
| 623235 | 12/1935 | Germany . |
| 974395 | 12/1960 | Germany . |
| 254080A1 | 2/1988 | Germany . |
| 2948350C2 | 2/1990 | Germany . |
| 424941 | 5/1967 | Switzerland . |
| 581377 | 10/1976 | Switzerland . |

OTHER PUBLICATIONS

"Keramische Kaltleiter schutzen elektronische Schaltungen", Kainz, Siemens Components 28 (1990) Heft I, pp. 13–16.

"Fullstoffhaltige elektrisch leitfahige Kunststoffe", Mobius, et al., Kunststoffe 78 (1988) 1, pp. 53–58.

"New, Z-direction anisotropically conductive composites", Jin, et al., J. Appl. Phys. 64 (10), 15 Nov. 1988, pp. 6008–6010.

*Primary Examiner*—Marvin M. Lateef

*Attorney, Agent, or Firm*—Burns, Doane, Swecker & Mathis

[57] ABSTRACT

A current-limiting component having an electrical resistance body arranged between two contact terminals. The resistance body contains a first resistance material having PTC behavior. Below a limit temperature, the first resistance material has a low cold resistivity and at least one current-carrying path extending between the two contact terminals. Above the limit temperature, the first resistance material has a high hot resistivity compared with its cold resistivity. The current-limiting component has uniform switching capability and high rated current-carrying capacity despite simple and inexpensive construction. The resistance body additionally contains second resistance material having a resistivity which is between the cold resistivity and the hot resistivity of the first resistance material. The second resistance material is in intimate electrical contact with the first resistance material and forms at least one resistance path connected in parallel with the current-carrying path.

24 Claims, 2 Drawing Sheets

CURRENT-LIMITING COMPONENT

BACKGROUND OF THE INVENTION

1. Field of the Invention

The invention proceeds from a current-limiting component having an electrical resistance body arranged between two contact terminals and containing first resistance material, which material has PTC behavior and a low cold resistivity below a first temperature and forms at least one current-carrying path extending between the two contact terminals and which material has a high hot resistivity compared with its cold resistivity above the first temperature.

2. Discussion of Background

Resistors having PTC behavior have already been prior art for a long time and are disclosed, for example, in DE 2 948 350 C2 or U.S. Pat. No. 4,534,889 A. Such resistors always contain a resistance body composed of a ceramic or polymeric material which has PTC behavior and conducts electrical current well below a limit temperature specific to the material. PTC material is, for example, a ceramic based on doped barium titanate or an electrically conductive polymer, for instance a thermoplastic, semicrystalline polymer, such as polyethylene, containing, for example, soot as conductive filler. When the limit temperature is exceeded, the resistivity of the resistor based on a PTC material increases abruptly by many orders of magnitude.

PTC resistors can therefore be used as overload protection for circuits. Because of their limited conductivity (carbon-filled polymers have, for example, a resistivity of more than 1 Ω·cm), they are generally limited in their practical application to rated currents of up to approximately 8 A at 30 V and up to approximately 0.2 A at 250 V.

J. Mat. Sci. 26 (1991), 145 ff. provides PTC resistors based on a polymer filled with borides, silicides or carbides which have very high conductivity at room temperature and which could in principle be used as current-limiting components even in power circuits involving currents of, for example, 50 to 100 A at 250 V. Resistors of this type are, however, not commercially available and cannot therefore be produced without appreciable effort.

If a PTC resistor is used as current-limiting protective component in an electrical network designed for high operating currents and high operating voltages, appreciable energy is converted in the PTC resistor during the turn-off process if a short circuit occurs. In particular, if the turn-off process takes place nonuniformly in the PTC resistor, this can result in the PTC resistor forming locally overheated regions, so-called "hot spots", approximately in the center between the contact terminals. In the overheated regions, the PTC resistor switches to the high-resistance state earlier than at the unheated points. The entire voltage applied across the PTC resistor then drops over a relatively small distance at the point of the highest resistance. The high electrical field associated therewith may then result in breakdown and in damage to the PTC resistor.

SUMMARY OF THE INVENTION

Accordingly, one object of the invention is to provide a novel current-limiting component which has PTC behavior and which is distinguished by uniform switching capability and high rated current-carrying capacity despite simple and inexpensive construction.

The current-limiting component according to the invention comprises easily manipulable components such as a resistance having PTC behavior and a resistance having linear, nonlinear or PTC behavior and is of simple construction. It can therefore not only be produced comparatively inexpensively but can at the same time also be given small dimensions. Integration of one or more linear or nonlinear resistances or resistances having PTC behavior, which resistances are arranged in parallel with the PTC resistance, achieves a reduction in the load on the PTC resistance performing the switching function. At the same time, the unwanted occurrence of "hot spots" is suppressed by commutating the current to be limited into the resistance connected in parallel with the PTC resistance. This achieves a uniform switching behavior and an increase in the permissible energy density.

Locally occurring overvoltages can be limited in a simple manner and one which is matched to the particular conditions by external additional circuits involving capacitors, varistors and/or linear resistors.

The integration of the parallel resistance at the same time removes the heat energy generated in the PTC resistor more rapidly and thus appreciably increases the rated current-carrying capacity of the current-limiting component according to the invention. If the parallel resistance is composed of a material of high thermal conductivity, it also ensures that the temperature distribution is made more uniform in the resistor according to the invention. This is particularly effective in counteracting the risk of a local overheating.

Preferred exemplary embodiments of the invention and the further advantages achievable therewith are explained in greater detail below by reference to the drawings.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein, in a simplified form.

DESCRIPTION OF THE PREFERRED EMBODIMENTS

Figure 1:
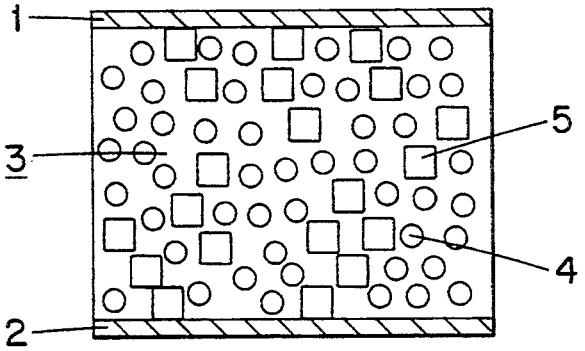
FIGS. 1 to 3 and 5 to 9 each show a view of a section through one of eight preferred embodiments of the current-limiting component according to the invention in each case.

Referring now to the drawings, wherein like reference numerals designate identical or corresponding parts throughout the several views, the current-limiting components shown in FIGS. 1 to 10 each contain a resistance body 3 arranged between two contact terminals 1, 2. Resistance sub-bodies designated by the reference numeral 4 contain first resistance material which has PTC behavior. This resistance material has a low cold resistivity below a first temperature and, after incorporation in an electrical network to be protected by current limitation, forms at least one path which extends between the two contact terminals 1, 2 and preferably carries rated current. Above the first temperature, the resistance material has a high hot resistivity compared with its cold resistivity.

Resistance sub-bodies designated by the reference symbol 5 are formed by a second resistance material having a resistivity which is between the cold resistivity and the hot resistivity of the first resistance material forming the resistance sub-bodies 4. The resistance material forming the resistance sub-bodies 5 has been brought into intimate electrical contact with the resistance material forming the resistance sub-bodies 4 and forms at least one resistance connected in parallel with at least one subsection of the path carrying rated current.

The resistance connected in parallel with the current-carrying path and composed of second resistance material is greater than the cold resistance of the first resistance material. Preferably, the magnitude of the resistance composed of second resistance material is approximately 3–$10^4$ times the magnitude of the cold resistance of the first resistance material and advantageously has PTC behavior itself.

As shown in FIG. 1, the resistance body 3 may have a matrix preferably formed from a polymer, such as a thermosetting or thermoplastic polymer. Embedded in said matrix to form the resistance materials of the resistance sub-bodies 4, 5 are fillers. Said fillers may be present in the form of powder, fibers and/or platelets. In this connection, short fibers or platelets are particularly to be preferred as fillers since in that case a particularly low percolation concentration for the purpose of achieving the PTC behavior can be maintained.

In FIG. 1, the fillers provided in the resistance sub-bodies 4 are shown as circles and the fillers provided in the resistance sub-bodies 5 as squares. In normal operation, the filler provided in the resistance sub-body 4 forms current paths passing through the resistance body 3 and effects at the same time the PTC effect. The material of the resistance sub-bodies 5, on the other hand, forms, depending on the amount added, paths which percolate locally or through the entire resistance body 3 and into which, when the resistance of the current paths increases during a current-limitation process, current commutates and, consequently, the unwanted formation of overheated regions in the resistance sub-bodies 4 having PTC behavior can be prevented.

The filler provided in the first resistance material contains electrically conducting particles in the form of carbon and/or of a metal, such as, for example, nickel, and/or at least one boride, silicide, oxide and/or carbide, such as, for instance, $TiC_2$, $TiB_2$, $MoSi_2$ or $V_2O_3$, in undoped or doped form in each case.

The filler provided in the second resistance material contains at least one doped semiconducting ceramic, for instance based on ZnO, $SnO_2$, $SrTiO_3$, $TiO_2$, SiC, $YBa_2Cu_3O_{7-x}$, a granular metal material, an intrinsically electrically conducting plastic or a plastic rendered electrically conducting by fine filler and/or short or long fibers.

The concentration and the geometrical dimensions of the filler provided in the resistance sub-bodies 5 are adjusted in such a way that a current commutation from a resistance sub-body 4 to a resistance sub-body 5 can take place locally in each case. The filler provided in the resistance sub-bodies 5 may, but does not necessarily need to, form continuous current paths. The proportion of the filler forming the resistance sub-bodies 4 may be between 15 and 50% by volume and that of the filler forming the resistance sub-bodies 5 may be between 5 and 40% by volume, while the polymer matrix embedding the fillers should have a proportion of 20–60% by volume of the resistance body 3.

If the filler of a resistance sub-body is composed of a paramagnetic or ferromagnetic material, the particles can be aligned with a strong magnetic field during the curing of the polymer matrix or in the melt of the polymer matrix. In this case, the field extends in the direction from contact terminal 1 to contact terminal 2. Chains which act as current paths and which are predominantly composed of the filler of the one or of the other resistance sub-bodies are thus formed.

As a result of the integration of parallel resistances in the resistor having PTC behavior, the load on said resistor when it performs switching functions is appreciably reduced. The addition of the parallel resistance does indeed effect, above the transition temperature of the resistor having PTC behavior, a reduction in the overall resistivity of the current-limiting component of typically $10^8$ Ω·cm to a markedly lower value which may advantageously be approximately 3 to $10^4$ times the cold resistance of the resistor having PTC behavior. However, the current to be turned off can already be sufficiently limited thereby and the circuit carrying the current can be mechanically isolated.

Depending on the application case, a circuit comprising an external parallel resistor, varistor or capacitor may additionally be provided. However, the current-limiting component according to the invention always suppresses unwanted "hot spots" in the resistance sub-bodies 4 having PTC behavior, renders the switching behavior uniform and increases the permissible energy density in the switching process. At the same time, some of the heat generated in the resistance sub-bodies 4 is dissipated by the resistance sub-bodies 5. This appreciably increases the rated current-carrying capacity of the current-limiting component according to the invention compared with a current-limiting component without parallel-connected resistances.

The resistance material of the resistance sub-bodies 5 generally has linear or, alternatively, nonlinear behavior, but it may possibly also have PTC behavior in accordance with the resistance material provided in the resistance sub-bodies 4. If the resistance material has PTC behavior, the transition temperature is equal to, or higher than, that of the resistance material contained in the resistance sub-bodies 4. As a result, a time-delayed turn-off in two stages is achieved. Overvoltages are thus reduced in turning inductive networks off since a rapid partial limitation of the current first takes place and only after that a complete current limitation.

Figure 2:
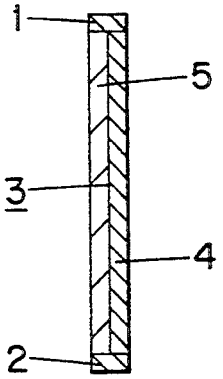
Figure 3:
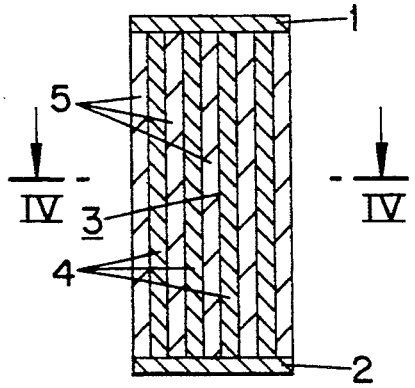
Figure 4:
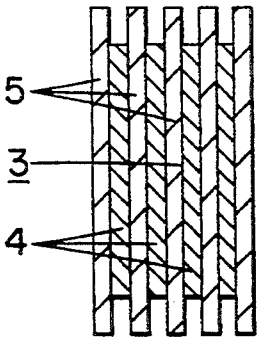
FIG. 4 shows a view of a section taken along IV—IV through the embodiment shown in FIG. 3.

In the embodiments shown in FIGS. 2 to 4, the resistance body 3 is made up of two or more two-dimensional resistance sub-bodies 4, 5 preferably formed in each case as a plate. The resistance sub-body 5 shown in FIG. 2 is, or the resistance sub-bodies 5 shown in FIGS. 3 and 4 are, contacted by two terminals 1, 2. In the normal operation of the current-limiting component, the resistance sub-bodies 5 have a resistance which is a plurality of times higher than the resistance of sub-bodies 4. Like the resistance sub-bodies 5, the resistance sub-bodies 4 are also contacted by the two terminals 1, 2. Over their entire two-dimensional extent, the resistance sub-bodies 4 and 5 have common contact surfaces. At said contact surfaces, the resistance sub-bodies 4, 5 are brought into intimate electrical contact with one another.

The resistance bodies 3 can be produced as follows: plates approximately 0.5 to 2 mm thick and made of an electrically conducting, doped ceramic are first produced by a method which is standard in the production of resistors such as, for instance, by pressing or casting and subsequent sintering. PTC material based on a polymer is produced from epoxy resin and an electrically conductive filler such as, for example, TiC using a shearing mixer. Said polymer is cast in a thickness of 0.5 to 4 mm onto a previously produced plate-type ceramic. It is optionally possible to cover the cast layer with a further ceramic and to repeat the process steps described above successively. This results in a stack in which layers composed of the two different resistance materials are disposed alternately one after the other in accordance with a multilayer arrangement. The epoxy resin is then cured at temperatures between 60° and 180° C. to form the resistance body 3.

Particularly suitable is a resistance sub-body 5 composed of a resistance material which has a high tensile strength and/or high elasticity since then thermal stresses, which may be produced by strongly heating the resistance material with PTC behavior, are avoided in every case. Suitable material for this purpose is, for example, a filled elastomer or thermoplastic or a screen cloth.

As can be seen from FIG. 4, the resistance sub-bodies 5 formed from second resistance material may project beyond the resistance sub-bodies 4 in rib fashion. The projecting parts of the resistance sub-bodies 5 then act as cooling ribs and effect a particularly good dissipation of the heat generated in the resistance sub-bodies 4.

Instead of a thermosetting PTC polymer, a thermoplastic PTC polymer may also be used as resistance material for the resistance sub-bodies 4. This is first extruded to form thin plates or foils which, when assembled with the resistance sub-bodies 5, are hot-pressed to form the resistance body 3.

If the two resistance materials used are each a ceramic, the two-dimensional resistance sub-bodies 4, 5 can be joined together by bonding by means of an electrically anisotropically conducting elastomer. In order to form the intimate electrical contact between the different ceramics, said elastomer should have a high adhesive force. Moreover, said elastomer should be electrically conducting only in the direction of the normal to the two-dimensional components. Such an elastomer is disclosed, for example, in J. Applied Physics 64 (1984), 6008.

The resistance bodies 3 may subsequently be divided up by cutting. The resistance bodies produced in this way may, for example, have a length of 0.5 to 20 cm and end faces of, for example, 0.5 to 10 $cm^2$. The end faces of the resistance bodies 3 having sandwich structure are smoothed, for instance, by lapping and polishing and may be joined to the contact terminals 1, 2 by soldering on with a low-melting solder or by glueing on with a conductive adhesive or by hot pressing.

The current-limiting component shown in FIGS. 2 or 3, and 4, normally conducts during the operation of a system incorporating it. Under these circumstances, the current flows in an electrically conducting path, extending between the contact terminals 1 and 2, of a resistance sub-body 4. If the resistance sub-body 4 heats up so strongly because of an excess current that its resistance abruptly increases by many orders of magnitude, the excess current is limited. Since the resistance sub-bodies 5 are in intimate electrical contact with the resistance sub-bodies 4 over their entire length and are connected in parallel with their current paths carrying excess current, severely overheated, nonuniform regions are avoided under these circumstances in the resistance sub-bodies 4 having PTC behavior. Before such nonuniform regions of this type are formed, at least some of the current to be turned off commutates into the resistance sub-bodies 5 composed of second resistance material. The comparatively high thermal conductivity of the resistance sub-bodies 5 at the same time ensures that the temperature distribution is rendered uniform in the resistance sub-bodies 4, thereby additionally reducing the risk of local overheating in these parts. In addition, the high heat dissipation in the resistance sub-bodies 5 contributes to increasing appreciably the rated current-carrying capacity of the current-limiting component according to the invention compared with that of a current-limiting component according to the prior art.

Figure 5:
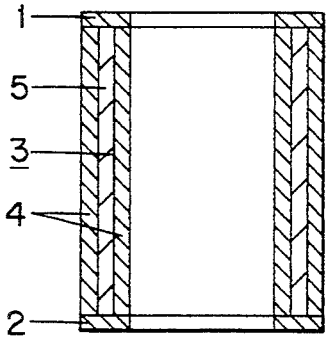

FIG. 5 shows a resistor according to the invention which is of tubular construction and is cut along its tubular axis. This resistor contains a resistance sub-body 5, which serves for current commutation, and two resistance sub-bodies 4 having PTC behavior. The resistance sub-bodies 4, 5 are each hollow cylinders and, together with annular contact terminals, they form a tubular current-limiting component. This component may advantageously be produced from a hollow-cylindrical ceramic which is coated on the inside surface and on the lateral surface with a polymeric PTC casting composition, for instance based on epoxy resin, in a cylindrical casting mold. Instead of a hollow-cylindrical ceramic, a solid-cylindrical ceramic may also be used. A current-limiting component having a resistance sub-body 5 of this type is particularly simple to manufacture, whereas a current-limiting component formed as a tube has a particularly good heat dissipation as a result of convection and can be cooled particularly well with a liquid. If a thermoplastic polymer is used as PTC material instead of a thermosetting polymer, the PTC material can be extruded directly onto the cylinder or the hollow cylinder. If a polymer/filler composite, for example one having a high C, SiC, ZnO and/or $TiO_2$ filler loading, is used as resistance material for the resistance sub-body 5, the current-limiting component according to the invention can be produced in a particularly simple manner by coextrusion. In this case it is also possible to provide a resistance sub-body 5 having long, coextruded wires or fibers, for example based on metal, carbon or silicon carbide. The resistance sub-body 5 may also have a single winding comprising a conducting fiber or wire. In the case of this embodiment of the invention, a particularly good mechanical robustness is achieved.

Figure 6:
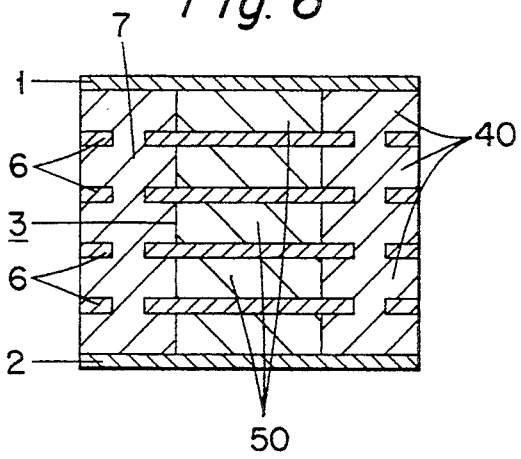
Figure 7:
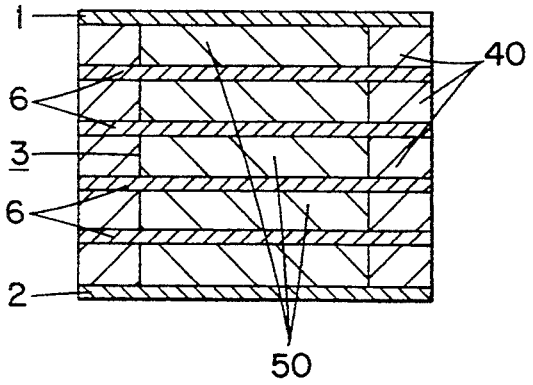
Figure 8:
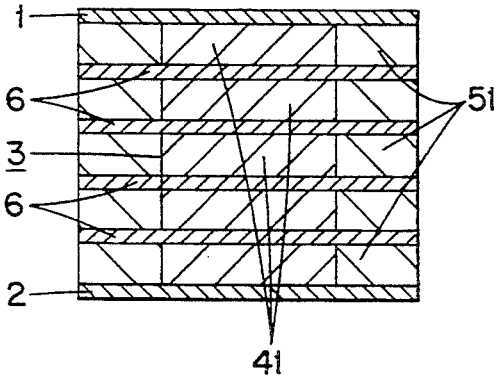

In the embodiments shown in FIGS. 6 to 8, the resistance body 3 has, in each case, the form of a solid cylinder comprising resistance sub-bodies stacked one on top of the other. The resistance sub-bodies composed of second resistance material are formed as circular disks 50 or as annular bodies 51 and the resistance sub-bodies 4 having PTC behavior are formed in a congruent manner as annular bodies 40 or as circular disks 41. In contrast to the preceding embodiments, contact disks 6 are additionally provided. Each resistance sub-body formed as disk 50 or as annular body 51 is in intimate electrical contact over its entire circumference with a resistance sub-body having PTC behavior formed as annular body 40 or as disk 41. Every part 50, 51 and every part 40, 41 contacted by it is either contacted by one of the two contact terminals 1, 2 and a contact disk 6, or by two contact disks 6. The annular bodies 50 or the disks 51 having linear resistance behavior, or the annular bodies 40 or the disks 41 having PTC behavior are thus connected in series between the contact terminals 1, 2 in each of the embodiments shown in FIGS. 6 to 8.

The current-limiting components shown in FIGS. 6 to 8 can be produced as follows: the disks 50 and annular bodies 51 can be produced from powdered ceramic material such as, for instance, suitable metal oxides by pressing and sintering. The diameters of the disks may, for example, be between 0.5 and 5 cm and those of the annular bodies between 1 and 10 cm, with a thickness of, for example, between 0.05 and 1 cm. The disks 50 are stacked one on top of the other, with the contact disks 6 situated in between. The contact disks 6 may in this case have holes 7 of any desired shape in the peripheral region and may be formed possibly even as a lattice. The stack is introduced into a casting mold. The space still free between the contact disks 6 is then filled with polymeric PTC material by casting to form the annular bodies 40 and the cast stack is cured. Contact is then made through the top and bottom of the stack.

In current-limiting components produced in this way, the metallic contact disks 6 ensure a low contact resistance in a current path formed by the disks 40 or annular bodies 41 connected in series in each case. Any overvoltages occurring can be removed via the entire circular cross section of the disks 50. The holes 7 filled with PTC material reduce the overall resistance in the current path of the resistance sub-bodies having PTC behavior and formed as annular bodies 40. Local overvoltages in the resistance during overheating are particularly satisfactorily avoided in this embodiment since the resistor is subdivided into subsections by the contact disks 6 and since, in every subsection, a resistance sub-body formed as disk 50 and composed of second resistance material is connected in parallel with a resistance sub-body having PTC behavior and formed as annular body 40 and is consequently connected in parallel with a subsection of the current path producing the local overvoltages.

The annular bodies 40 may also be sintered from ceramic. Perforation of the contact disks 6 is then unnecessary. The contact resistance can in this case be kept low by pressing or soldering.

As can be seen from the embodiment shown in FIG. 8, the resistance sub-bodies may be formed from second resistance material as annular bodies 51 and the resistance sub-bodies having PTC behavior as circular disks 41. In order to achieve a low overall resistance in this embodiment if a polymeric PTC material is used, it is advisable to provide holes in a central region of the contact disks 6.

Figure 9:
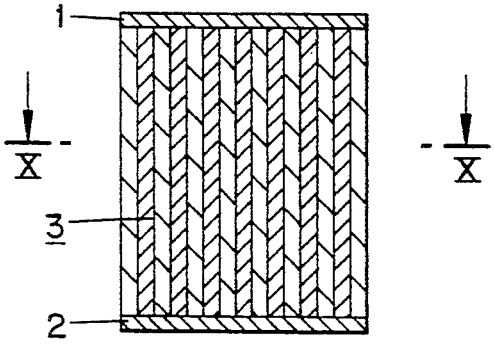
Figure 10:
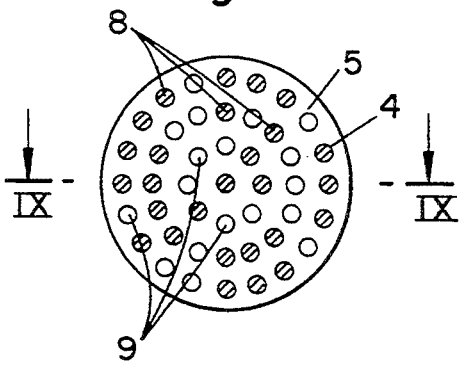
FIG. 10 shows a view of a section taken along X—X through the embodiment shown in FIG. 9.

In the embodiment shown in FIGS. 9 and 10, the resistance sub-body 5 is of cylindrical construction and has through bores 8, 9 having, for example, a diameter of 1 to 5 mm. The resistance sub-body 5 is preferably composed of a material which has a high tensile strength and/or is elastic. Into the through bores 8 there are cast resistance sub-bodies 4, preferably those based on thermosetting material, such as, for instance, epoxy, or there are pressed resistance sub-bodies 4, preferably those based on thermoplastics, such as, for instance, polyethylene. The through bores 9 are kept open for cooling purposes.

In all the embodiments shown in FIGS. 5–10, the resistance sub-body 5 or 50, 51 may itself also have PTC behavior, just as in the embodiments shown in FIGS. 1–4.

If the current-limiting component according to the invention is used in the medium-voltage range, i.e. in particular in networks having voltages in the kilovolt range, its dimensions perpendicular to the current flow should be small compared with its length parallel to the current flow. If the current-limiting component according to the invention is used in the low-voltage range, i.e. in particular in networks having voltages up to 1 kilovolt, its dimensions perpendicular to the current flow should be large compared with its length parallel to the current flow. If the current-limiting component is, for example, essentially of cylinder-symmetrical construction, it has a small diameter compared with its axial length when used for voltages in the kilovolt range and a large diameter compared with its axial length when used for voltages up to 1000 V.

Obviously, numerous modifications and variations of the present invention are possible in light of the above teachings. It is therefore to be understood that within the scope of the appended claims, the invention may be practiced otherwise than as specifically described herein.

What is claimed:

1. A current-limiting component which has an electrical resistance body arranged between two contact terminals and contains first resistance material, which material has PTC behavior and a low cold resistivity below a first temperature and forms at least one current-carrying path extending between the two contact terminals and which material has a high hot resistivity compared with its cold resistivity above the first temperature, wherein the resistance body additionally contains second resistance material having a resistivity which is between the cold resistivity and the hot resistivity of the first resistance material and wherein the second resistance material has been brought into intimate electrical contact with the first resistance material and forms at least one resistance connected in parallel with at least one subsection of the at least one current-carrying path, the magnitude of the resistivity of the second resistance material being approximately $3–10^4$ times the magnitude of the cold resistivity of the first resistance material.

2. The current-limiting component as claimed in claim 1, wherein the second resistance material has, below a second temperature, which is equal to, or higher than, the first temperature, a low cold resistivity and, above the second temperature, a high hot resistivity compared with its cold resistivity.

3. The current-limiting component as claimed in claim 1, wherein the first and second resistance materials each form at least one resistance sub-body contacted by two contact terminals.

4. The current-limiting component as claimed in claim 3, wherein the resistance sub-bodies formed from first and second resistance materials are each formed as a plate, and wherein resistance sub-bodies which follow one another and are composed of the first and second resistance materials are arranged in the form of a stack.

5. The current-limiting component as claimed in claim 4, wherein the plates composed of the second resistance material project beyond the plates composed of first resistance material to form cooling ribs.

6. The current-limiting component as claimed in claim 3, wherein a resistance sub-body formed from the second resistance material has through bores for receiving resistance sub-bodies composed of the first resistance material.

7. The current-limiting component as claimed in claim 1, wherein through bores are provided which are kept open for cooling purposes.

8. The current-limiting component as claimed in claim 3, wherein the first resistance material is a ceramic which is mounted on an adjacent resistance sub-body to form the intimate electrical contact by means of an electrically anisotropically conducting material.

9. The current-limiting component as claimed in claim 8, wherein the second resistance material has high tensile strength and/or high elasticity.

10. The current-limiting component as claimed in claim 8, wherein the electrically anisotropically conducting material comprises an elastomer.

11. The current-limiting component as claimed in claim 9, wherein the first resistance material is a polymer which is produced by casting onto an adjacent resistance sub-body and subsequent curing or by placing it as a plate-like or sheet-type element on an adjacent resistance sub-body and subsequent hot pressing.

12. The current-limiting component as claimed in claim 3, wherein the resistance body has at least a first and at least a second resistance sub-body which are each formed from the second resistance material and of which a first resistance sub-body is contacted by a first of the two contact terminals and a contact disk and a second resistance sub-body is contacted either by two contact disks or a contact disk and a second of the two contact terminals.

13. The current-limiting component as claimed in claim 12, wherein the first and second resistance sub-bodies are each formed as annular bodies, and wherein said annular bodies each surround a circular disk formed from the first resistance material.

14. A current-limiting component which has an electrical resistance body arranged between two contact terminals and contains first resistance material, which material has PTC behavior and a low cold resistivity below a first temperature and forms at least one current-carrying path extending between the two contact terminals and which material has a high hot resistivity compared with its cold resistivity above the first temperature, wherein the resistance body additionally contains second resistance material having a resistivity which is between the cold resistivity and the hot resistivity of the first resistance material and wherein the second resistance material has been brought into intimate electrical contact with the first resistance material and forms at least one resistance connected in parallel with at least one subsection of the at least one current-carrying path, the resistance body having a material matrix in which at least two different fillers are embedded to form the first and second resistance material.

15. The current-limiting component as claimed in claim 4, wherein the fillers are embedded in a polymer matrix in the form of powder, fibers and/or platelets.

16. The current-limiting component as claimed in claim 5, wherein the filler provided in the first resistance material contains electrically conducting particles in the form of carbon and/or at least one metal and/or at least one boride, silicide, oxide and/or carbide, and wherein the filler provided in the second resistance material contains at least one doped semiconducting ceramic, a granular metal material, an electrically conducting plastic and/or short or long fibers.

17. A current-limiting component which has an electrical resistance body arranged between two contact terminals and contains first resistance material, which material has PTC behavior and a low cold resistivity below a first temperature and forms at least one current-carrying path extending between the two contact terminals and which material has a high hot resistivity compared with its cold resistivity above the first temperature, wherein the resistance body additionally contains second resistance material having a resistivity which is between the cold resistivity and the hot resistivity of the first resistance material and wherein the second resistance material has been brought into intimate electrical contact with the first resistance material and forms at least one resistance connected in parallel with at least. One subsection of the at least one current-carrying path, the filler of the first and/or second resistance material being composed at least partially of paramagnetic or ferromagnetic material, and having chains which are formed from first and/or second resistance material and which extend along the field lines of a magnetic field producing the chain formation.

18. A current-limiting component which has an electrical resistance body arranged between two contact terminals and contains first resistance material, which material has PTC behavior and a low Cold resistivity below a first temperature and forms at least one current-carrying path extending between the two contact terminals and which material has a high hot resistivity compared with its cold resistivity above the first temperature, wherein the resistance body additionally contains second resistance material having a resistivity which is between the cold resistivity and the hot resistivity of the first resistance material and wherein the second resistance material has been brought into intimate electrical contact with the first resistance material and forms at least one resistance connected in parallel with at least one subsection of the at least one current-carrying path, the first and second resistance materials each forming at least one resistance sub-body contacted by two contact terminals, wherein the resistance sub-bodies formed from the first and second resistance materials are each formed as a hollow cylinder or solid cylinder, and wherein resistance sub-bodies which follow one another in alternating fashion are composed of the first and second resistance materials and are arranged to form a tube or a solid cylinder.

19. A current-limiting component which has an electrical resistance body arranged between two contact terminals and contains first resistance material, which material has PTC behavior and a low cold resistivity below a first temperature and forms at least one current-carrying path extending between the two contact terminals and which material has a high hot resistivity compared with its cold resistivity above the first temperature, wherein the resistance body additionally contains second resistance material having a resistivity which is between the cold resistivity and the hot resistivity of the first resistance material and wherein the second resistance material has been brought into intimate electrical contact with the first resistance material and forms at least one resistance connected in parallel with at least one subsection of the at least one current-carrying path, the resistance body has at least a first and at least a second resistance sub-body which are each formed from the second resistance material and of which a first resistance sub-body is contacted by a first of the two contact terminals and a contact disk and a second resistance sub-body is contacted either by two contact disks or a contact disk and a Second of the two contact terminals, wherein the first and the second resistance sub-bodies are each formed as a circular disk, and wherein said disks are each surrounded by an annular body formed from the first resistance material.

20. The current-limiting component as claimed in claim 19, wherein the contact disks have holes which are filled with first resistance material and by which the disks or annular bodies composed of the first resistance material are joined together.

21. The current-limiting component as claimed in claim 20, wherein the first resistance material contains a thermosetting or thermoplastic polymer which, after a stack containing the contact disks and the first and second resistance sub-bodies has been assembled, is cast or hot-pressed into the stack to form the annular bodies or the disks.

22. The current-limiting component as claimed in claim 19, wherein the annular bodies or disks composed of first resistance material are composed of ceramic.

23. A current-limiting component which has an electrical resistance body arranged between two contact terminals and contains first resistance material, which material has PTC behavior and a low cold resistivity below a first temperature and forms at least one current-carrying path extending between the two contact terminals and which material has a high hot resistivity compared with its cold resistivity above the first temperature, wherein the resistance body additionally contains second resistance material having a resistivity which is between the cold resistivity and the hot resistivity of the first resistance material and wherein the second resistance material has been brought into intimate electrical contact with the first resistance material and forms at least one resistance connected in parallel with at least one subsection of the at least one current-carrying path, the current-limiting component being essentially of cylinder-symmetrical construction having a large diameter compared with its axial length and being useful for voltages up to 1000 V.

24. A current-limiting component which has an electrical resistance body arranged between two contact terminals and Contains first resistance material, which material has PTC behavior and a low cold resistivity below a first temperature and forms at least one current-carrying path extending between the two contact terminals and which material has a high hot resistivity compared with its cold resistivity above the first temperature, wherein the resistance body additionally contains second resistance material having a resistivity which is between the cold resistivity and the hot resistivity of the first resistance material and wherein the second resistance material has been brought into intimate electrical contact with the first resistance material and forms at least one resistance connected in parallel with at least one sub section of the at least one current-carrying path, the current-limiting component being essentially of cylinder-symmetrical construction having a small diameter compared with its axial length and being useful for voltages in the kilovolt range.

* * * * *